United States Patent [19]

Sanuki et al.

[11] Patent Number: 4,963,074

[45] Date of Patent: Oct. 16, 1990

[54] VARIABLE DISPLACEMENT SWASH-PLATE TYPE COMPRESSOR

[75] Inventors: Masami Sanuki, Kariya; Fumihiro Itoigawa, Nagoya; Akikazu Kojima, Gamagori; Mitsuo Inagaki, Okazaki; Masanori Yasuda, Okazaki; Yoshiki Kurokawa, Okazaki; Kazuhito Miyagawa, Kariya; Seiichiro Suzuki, Nagoya; Shigeki Iwanami, Okazaki; Shiro Kawasaki, Anjo; Nobuhiro Miura, Okazaki, all of Japan

[73] Assignees: Nippondenso Co., Ltd., Kariya; Nippon Soken, Inc., Nishio, both of Japan

[21] Appl. No.: 293,434

[22] Filed: Jan. 4, 1990

[30] Foreign Application Priority Data

| | | | |
|---|---|---|---|
| Jan. 8, 1988 | [JP] | Japan | 63-1835 |
| Feb. 29, 1988 | [JP] | Japan | 63-46746 |
| Mar. 11, 1988 | [JP] | Japan | 63-58691 |
| May 14, 1988 | [JP] | Japan | 63-117987 |
| May 23, 1988 | [JP] | Japan | 63-125183 |

[51] Int. Cl.[5] ..... F04B 25/04

[52] U.S. Cl. ..... 417/222; 417/270

[58] Field of Search ..... 417/222, 222 S, 269, 417/270

[56] References Cited

U.S. PATENT DOCUMENTS

| | | | |
|---|---|---|---|
| 3,861,829 | 1/1975 | Roberts et al. | 417/53 |
| 3,959,983 | 6/1976 | Roberts et al. | 62/226 |
| 4,425,837 | 1/1984 | Livesay | 417/269 |

FOREIGN PATENT DOCUMENTS

| | | | |
|---|---|---|---|
| 97974 | 6/1982 | Japan | 417/269 |
| 58-162780 | 9/1983 | Japan . | |
| 58-162781 | 9/1983 | Japan . | |
| 58-162782 | 9/1983 | Japan . | |
| 58-162783 | 9/1983 | Japan . | |
| 17380 | 1/1987 | Japan | 417/269 |

*Primary Examiner*—Leonard E. Smith

*Attorney, Agent, or Firm*—Cushman, Darby & Cushman

[57] ABSTRACT

A swash plate type compressor has a rotary shaft, an inclined swash plate for rotation with the shaft, and a plurality of pistons connected to the swash plate. Each piston defines at both ends thereof a pair of working chambers. The piston reciprocates while being subjected to a swing motion concomitant with the rotation of the swash plate, to suck a fluid into the working chambers for compression. The swash plate is mounted on the shaft through a support unit which serves to selectively vary the inclination of the swash plate and shift the center of rotation of the swash plate along the shaft. The fluid is introduced from a suction passage through and around the swash plate to suction chambers formed adjacent the working chambers. A bypass passage is formed to directly communicate the suction passage with the suction chamber on one side of the shaft while bypassing the swash plate. When the inclination of the swash plate is decreased and the rotational center position thereof is shifted so that substantially no compression of fluid is completed in the working chambers on the one side of the shaft to decrease the displacement of the compressor, the fluid flows in the one side suction chamber through the bypass passage responsively to the flow of fluid toward another side working chambers to lubricate and cool sliding parts for the shaft.

14 Claims, 11 Drawing Sheets

VARIABLE DISPLACEMENT SWASH-PLATE TYPE COMPRESSOR

BACKGROUND OF THE INVENTION

The present invention relates to a variable displacement swash-plate type compressor which is particularly available as a refrigerant compressor for an automotive air-conditioning apparatus.

As a conventional displacement control for a compressor, for instance, as shown in Japanese Patent Unexamined Publication No. 58-162780 there have been known a swash-plate type in which a swash plate is provided on a rotary shaft of the compressor so that a change in inclination angle of the swash plate causes the reciprocating stroke of each piston to change.

However, a rotational center of the swash plate of the conventional swash-plate type compressor is kept constant, and the inclination angle of the swash plate is only changeable about a predetermined rotational center. For this reason, in the conventional displacement control, although the reciprocating stroke of each piston is changed in accordance with the inclination angle change of the swash plate, dead volumes would be increased in two working chambers in contact with opposite end faces of the piston. Thus, the compressor of this type is not suitable for compressing a refrigerant and the like which are compressible fluids.

In view of the foregoing problem inherent in the prior art, the present inventors et al have proposed an improved swash-plate type compressor in U.S. application Ser. No. 147,036 filed on Jan. 20, 1988, which is a CIP application of a parent application filed on Sept. 1, 1987.

In that compressor, a support portion for supporting the rotational center of the swash plate is provided to be shiftable relative to a rotary shaft of the compressor in the axial direction thereof, whereby the rotary center position of the swash plate may be shifted simultaneously with the inclination angle change thereof. With this structure, each piston of the compressor is moved so that the position of a top dead center in each working chamber formed on one side of the piston is kept substantially constant irrespective of the change in inclination angle of the swash plate. As a result, the suction and compression of a fluid can be performed in the working chamber to avoid the generation of large dead volume.

SUMMARY OF THE INVENTION

Accordingly, an object of the invention is to further improve a variable displacement swash plate type compressor proposed in the above-described earlier application.

Another object of the invention is to provide a variable displacement swash plate type compressor which has improved cooling and lubrication performances for sliding parts, rotational parts and the like.

Still another object of the invention is provide a variable displacement swash plate type compressor which is capable of cooling and lubricating the sliding parts, rotational parts and the like by introducing fluid around one of working chambers even if any compression or suction of fluid is not completed in the working chamber during the small displacement operation.

According to the present invention, a variable displacement swash plate type compressor comprises a shaft, a cylinder housing for defining a swash plate chamber and a plurality of cylinder bores each of which extends parallel to the shaft and around the shaft, a swash plate provided in the swash plate chamber, mounted on the shaft for rotation therewith, and inclined relative to the shaft, pistons slidably inserted into the cylinder bores, respectively, for defining pairs of working chambers in corporation with the cylinder bores at both ends of the pistons, each the pistons being connected to the swash plate and being reciprocated in accordance with a swing motion concomitant with rotation of the swash plate for sucking fluid to the pairs of working chambers to perform suction and compression strokes, a support for supporting the swash plate so as to be swingable relative to the shaft and to be movable in an axial direction of the shaft, thereby selectively varying the inclination of the shaft and shifting a center of rotation of said swash plate along the shaft, suction chambers each arranged adjacent to the pairs of working chambers, and suction passages for supplying the fluid through the swash plate chamber to the suction chambers. The compressor further comprises a bypass passage bypassing the swash plate chamber for communicating the suction passage and the suction chamber located on a first side of the shaft whereby, when the inclination of the swash plate is decreased and the center of rotation of the swash plate is shifted so that substantially no suction, compression and discharge of the fluid is completed in the working chambers located on the first side of the shaft to decrease displacement of the compressor, the fluid is recirculated from the suction passage through the bypass passage into the suction chamber located on the first side, thereby lubricating and cooling sliding parts relative to the shaft, disposed in contact with the suction chamber located on the first side.

The above-described and other objects, features and advantages will become more apparent by the following description taken in conjunction with the accompanying drawings.

DETAILED DESCRIPTION OF THE PREFERRED EMBODIMENTS

The analyses made by the present inventors as to the swash-plate type compressor described in the above-described application will now be described. It should be noted that these analyses constitute a part of the present invention.

Figure 14:
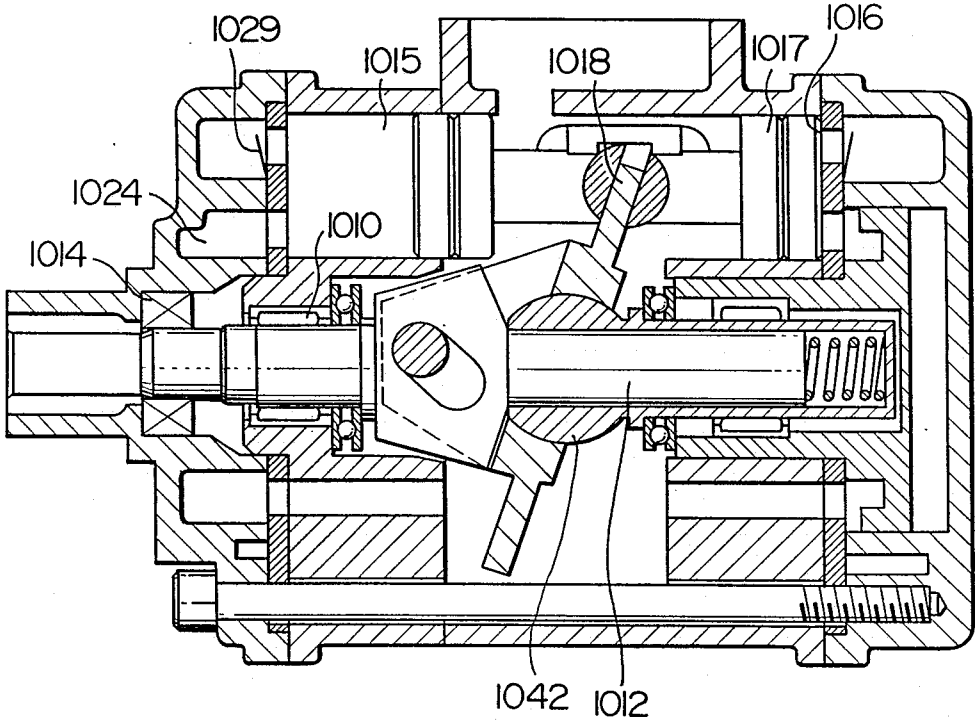
FIG. 14 is a cross-sectional view showing a variable displacement swash plate type compressor proposed in the prior application.

FIG. 14 shows a swash-plate type compressor proposed in the earlier application. As described before, the compressor is so constructed that a support portion 1042 for supporting the rotational center portion of a swash plate 1018 is displaceable in the axial direction of the shaft 1012 relative to the shaft 1012.

According to the structure of the compressor shown in FIG. 14, it is possible to change the inclinational angle of the swash plate 1018 and the rotational center position thereof in corporation with each other. As a result, a rear side working chamber 1016 formed on one side of a piston 1017 may be advanced irrespective of the inclination angle of the swash plate 1018 to the position where the suction compression of the fluid may be effected. On the other hand, in a front side working chamber 1015 formed on the other side of the piston 1017, there is an increased dead volume. As a result, in the case where the swash-plate angle is less than a certain level, the compression would not be substantially attained.

Thus, in the swash-plate type compressor shown in FIG. 14, it is possible to attain a variable control in a continuously stepless manner for the displacement capacity of the compressor from the maximum displacement at which both the front and rear working chambers 1015 and 1016 are operated at their maximum capacities to a minimum displacement at which the rear side working chamber 1016 solely is operated at its small capacity.

Figure 15:
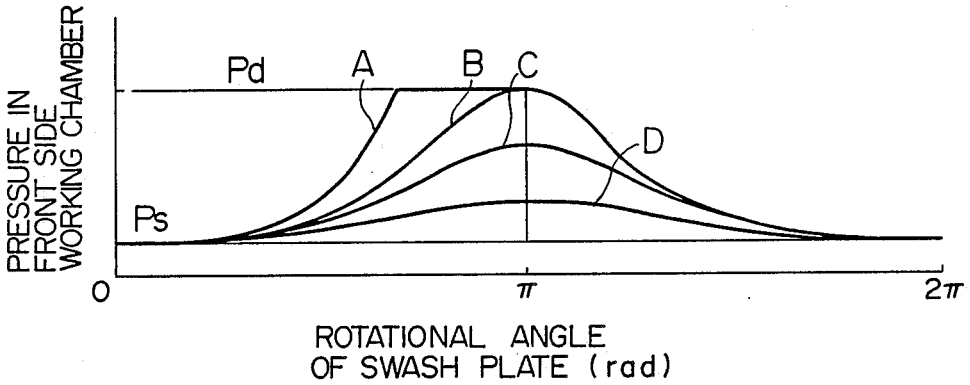
FIG. 15 is a graph showing pressure changes of the compressed fluid in the front side working chamber of the compressor shown in FIG. 14.

FIG. 15 is a graph showing a pressure change of fluid within the front side operating chamber of the compressor shown in FIG. 14. In FIG. 15, an abscissa represents an inclination angle of the swash plate, whereas an ordinate represents a fluid pressure. A maximum pressure of the fluid is a discharge pressure Pd, whereas the minimum pressure of the fluid is a suction pressure Ps. The discharge pressure Pd and the suction pressure Ps are determined by a capacity needed by an equipment such as, for example, a refrigeration cycle in which the compressor is to be used. The solid lines A, B, C and D in FIG. 15 show relationships between the pressure change and the discharge capacity within the front side working chamber 1015. The solid line A represent the condition where the front side working chamber 1015 is changed in volume at the maximum capacity. Namely, FIG. 15 shows the condition where the piston 1017 is reciprocatingly moved at a full stroke within the working chamber 1015. When the suction compression effect is attained in the front side working chamber at the maximum capacity as indicated by the solid line A, the pressure within the working chamber is changed from the suction pressure Ps to the discharge pressure Pd.

Under the condition where the inclination angle of the swash plate 1018 is decreased and the rotational center position of the swash plate 1018 is somewhat displaced toward the right in FIG. 14 (under the condition indicated by the solid line B in FIG. 15), the increment rate of the fluid pressure within the front side working chamber 1015 is decreased.

Under the condition where the inclination angle of the swash plate 1018 is further decreased, and the dead volume within the front side working chamber 1015 is increased, the pressure is changed as indicated by the solid curve C in FIG. 15. Under this condition, the fluid within the working chamber 1015 is not increased to the discharge pressure Pd. Namely, the fluid within the front side working chamber 1015 is simply repeatedly compressed and expanded in that chamber, and it is impossible to discharge the fluid against the closing force of a discharge valve 1029 to a discharge chamber 1025.

Under this condition, the fluid is not sucked from a suction chamber 1024 to the front side working chamber 1015. Accordingly, in such condition, there is no movement of fluid sucked into the working chamber 1015. In this compressor, since the sliding components or parts are lubricated by lubricant oil contained in the compression fluid, the fluid is prevented from flowing toward the front side working chamber 1015. As a result, there is a fear that a sticking will be made at the sliding parts. In particular, the fluid that flows toward the front side working chamber is used to cool and lubricate a bearing 1010 and a shaft sealing means 1014. Thus, a problem of an excessive heat and an insufficient seal would be raised at these parts.

Subsequently, preferred embodiments of the invention will now be described with reference to FIGS. 1 through 13.

Figure 1:
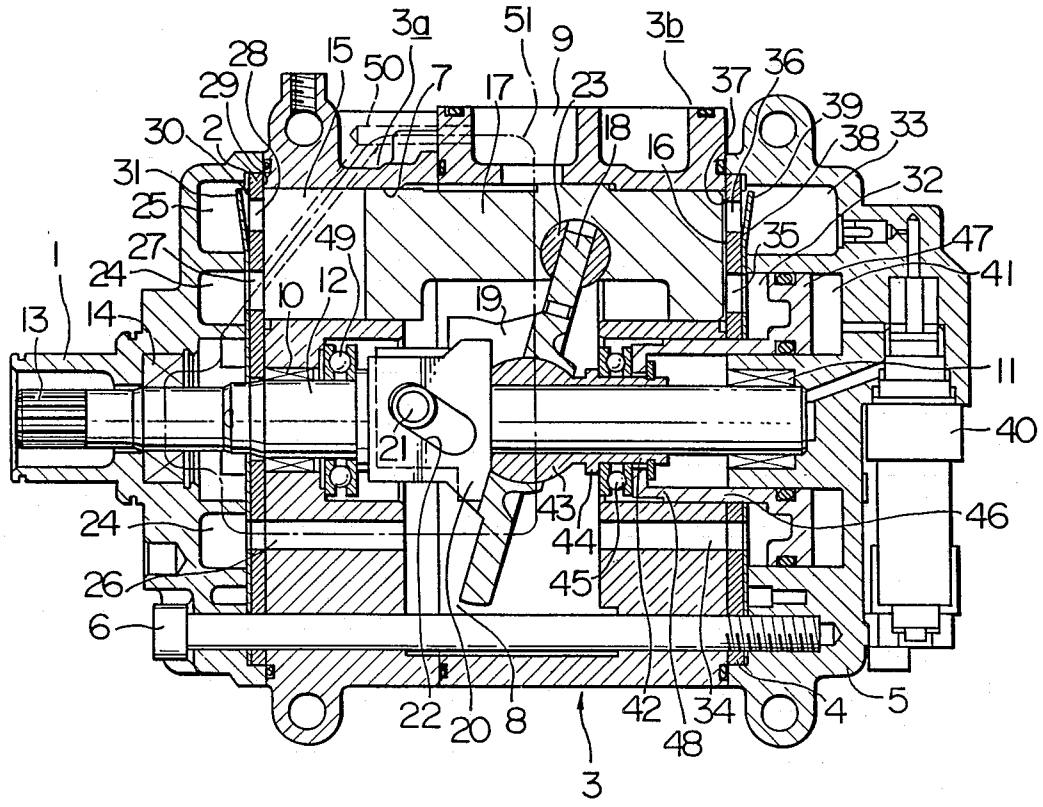
FIG. 1 is a cross-sectional view showing a variable displacement swash plate type compressor operated in a maximum displacement operation in accordance with a first embodiment of the invention.

FIG. 1 shows a variable displacement swashplate type compressor for compressing refrigerant in accordance with a first embodiment of the invention. An outer shell of the compressor is formed by a front housing 1, a front side plate 2, a cylinder block 3, a rear side plate 4 and a rear housing 5 which are made of aluminum alloy. The cylinder block 3 is formed of a front cylinder block 3*a* and a rear cylinder block 3*b* which are in abutment with each other. The front housing 1 is mounted through the side plate 2 on one side of the cylinder block 3 (on the left side in FIG. 1), and the rear housing 5 is mounted through the side plate 4 on the other side of the cylinder block 3 (on the right side in FIG. 1). These shell components are coupled in a unit by a plurality of bolts 6.

Figure 2:
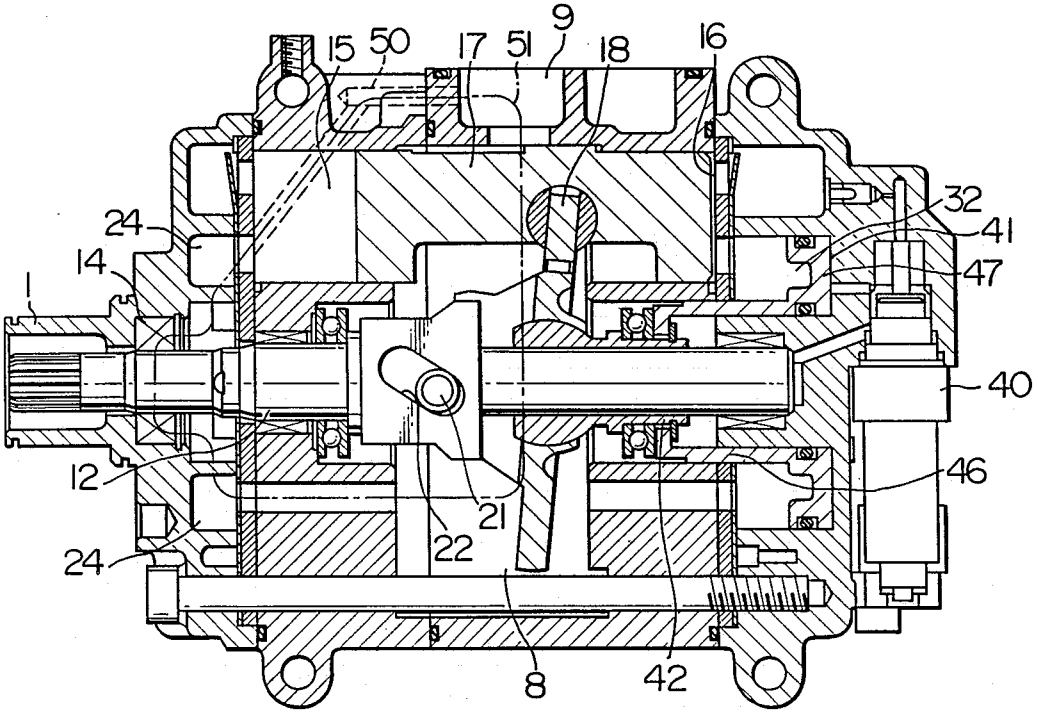
FIG. 2 is a cross-sectional view showing the compressor shown in FIG. 1 but operated in a minimum displacement operation.
Figure 3:
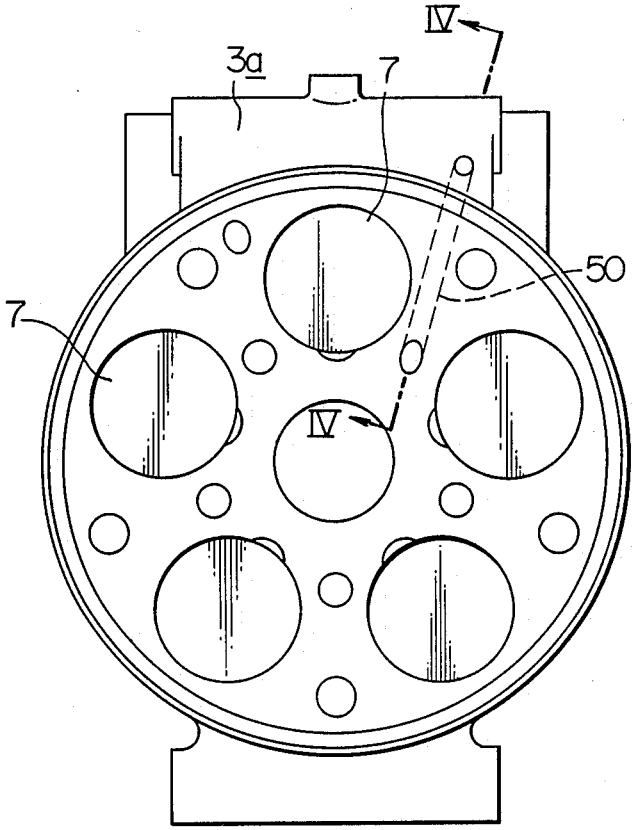
FIG. 3 is an end face view showing a cylinder block used in the compressor in the first embodiment.

A swash plate chamber 8 and cylinders 7 are formed by the front and rear cylinder blocks 3*a*, 3*b* within the cylinder block 3. Although only one cylinder 7 can be seen in FIGS. 1 and 2, five cylinder blocks are formed as best shown in FIG. 3 and are arranged in parallel with each other. A suction passage 9 is formed in the cylinder block 3 for introducing into the swash plate chamber 8 a coolant such as Freon R12. The coolant is introduced into a suction passage 9 through a suction side service valve (not shown) and is flowed into the swash plate chamber 8 from the suction passage 9 in a well known manner.

Also, a first bearing means 10 and a second bearing means 11 are disposed in the cylinder block 3 and the rear housing 5, respectively, to rotatably support a shaft 12. As shown in FIG. 3, the shaft 12 is arranged coaxially with the annular arrangement of the cylinders 7. One end 13 of the shaft 12 extends to the outside of the front housing 1 through a shaft sealing means 14 mounted on the front housing 1. The exposed end 13 is connected to an electromagnetic clutch (not shown) so that a rotational torque of an automotive vehicle may be transmitted to the shaft through the clutch.

A piston 17 that defines a first or front side working chamber 15 and a second or rear side working chamber 16 in corporation with an inner surface of each cylinder 7 is reciprocatingly inserted into each cylinder 7. Each piston 17 may be slidingly reciprocated by a swash plate 18 disposed within the swash-plate chamber 8.

The swash plate 18 has a projection at its central portion, and an axial slit 19 is formed in the projection. On the other hand, a planar plate portion 20 is formed in the shaft 1 at a position corresponding to the slit 19 of the swash plate. The swash plate 18 is obliquely mounted on the shaft 12 with its planar plate portion 20 engaged with the slit 19. Also, a pin 21 is fixed to the projection portion of the swash plate 18. The pin 21 is engaged through a collar with a slant groove hole 22 formed in the planar plate portion 20 of the shaft 12. With such an arrangement, the swash plate 18 is shifted between a position where the inclination angle is large as shown in FIG. 1 and a position where the inclination angle is small as shown in FIG. 2, while the pin 21 of the swash plate 18 is being slid within the groove hole 22. The rotational force of the shaft 12 is transmitted to the swash plate 18 through the engagement between the planar plate portion 20 and the slit 19. The swash plate 18 is driven to rotate about the axis of the shaft 12 together with the shaft 12 and to move in the axial direction of the shaft 12. Namely, the swash plate 18 is swung between the rightwardly upward inclination and the rightwardly downward inclination opposite thereto as shown in FIG. 1.

The circumferential peripheral portion of the swash plate 18 is connected to the piston 17 through a pair of shoes 23. The swash plate 18 is inserted slidingly into the space between the pair of shoes 23, 23. The shoes 23, 23 forms a single spherical shape under the condition that the shoes are in contact with the swash plate 18 and are rotatably mounted on recesses formed in the piston in a complementary manner. Accordingly, the swing motion concomitant with the rotation of the swash plate 18 is transmitted to the piston 17 through the shoes 23, 23 while the rotational motion components of the swash plate are released by the shoes 23 and 23. Only the swing motion components in the wising direction of the swash plate 18 are converted into the reciprocating motion of the piston 17. As a result, the piston 17 is reciprocated within the cylinder 7 so that the volumes of the front side working chamber 15 and the rear side working chamber 16 are alternatively increased and decreased.

The front housing 1 defines a first suction chamber 24 and a first discharge chamber 25. The shaft sealing means 14 is provided between the first suction chamber 24, the shaft 12 and the front housing 1 to prevent the coolant and the lubricant from leaking out. The first suction chamber 24 is in communication with the swash plate chamber 8 through a hole formed in the side plate 2 and a first passage 26 formed in the cylinder block 3 and is in communication with the front side working chamber 15 through a second passage 27 serving as a suction port formed in the side plate 2. Also, the first discharge chamber 25 is in communication with the front side working chamber 15 through a discharge port 28 formed in the side plate 2.

A suction valve 29 in the form of a sheet is provided on a surface, on the front side working chamber 15, of the side plate so that the suction valve 29 is opened when the piston 7 is moved rightwardly in FIG. 1. A sheet-like discharge valve 30 is provided on a surface, on the discharge chamber 25 side, of the side plate 2 so that the discharge valve 30 is opened when the piston is moved leftwardly in FIG. 1. The discharge valve 30 is converted by a valve cover 31.

The rear housing 5 defines a second suction chamber 32 and a second discharge chamber 33. The suction chamber 32 is in communication with the swash plate chamber 8 through a hole formed in the side plate 4 and a passage formed in the cylinder block 3. Also, the second suction chamber 32 is in communication with the rear side working chamber 16 through a suction hole 35. The second discharge chamber 33 is in communication with rear side working chamber 16 through a discharge hole 36 formed in the side plate 4. A suction valve 37, a discharge valve 38 and a valve cover 39 are mounted on the side plate 4 in the same manner as described before.

Incidentally, a switching valve 40 and a control chamber 41 are provided in the rear housing as will be described later.

A substantially cylindrical slider 42 is rotatably mount on the shaft 12 to be slidable in the axial direction of the shaft 12. The slider 42 is provided with a spherical support portion 43 at one end thereof close to the planar plate portion 20 of the shaft 12. The spherical support portion 43 causes the central position of the swash plate to move and allows the swash plate 18 to be rotatable about the axis of the shaft 18 and to be movable in the axial direction. The slider 42 has a flange portion 44 which is connected to one end of a spool 46 through a second thrust bearing 45.

The spool 46 has an annular piston portion 47 which is formed at the other end and is inserted into the second suction chamber 32 to divide the chamber into the suction chamber and a control chamber 41, and a cylindrical portion 48 which extends coaxially with the shaft 12 and the slider 43 from the piston portion 47 to the interior of the cylinder block 3. The cylindrical portion 48 of the spool 46 is slidably inserted into a cylindrical portion formed in the cylinder block **3*b*. Thus, the shift of the spool 46 in the axial direction is transmitted to the slider 42 through the second thrust bearing 45 and the flange portion 44. Incidentally, a first thrust bearing 49 is also provided on the shaft 21 on the side of the planar plate portion 20 and is clamped between the planar plate portion 20 of the shaft 12 and a retainer shoulder provided in the front cylinder block 3*a* to impart a thrust to the shaft 12**.

The above-described switching valve 40 serves to switch over the suction pressure and discharge pressure to be supplied to the control chamber 41. More specifically, the switching valve 40 selectively switches over between the condition where the control chamber 41 is in communication with the second discharge chamber 33 so that the coolant kept under discharge pressure is introduced into the control chamber 41 and the condition where the control chamber 41 is in communication with the second suction chamber 32 so that the coolant kept under the suction pressure is introduced into the control chamber 41.

Figure 4:
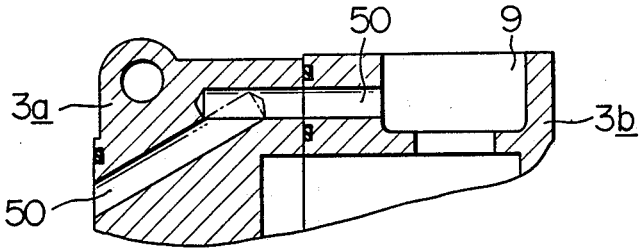
FIG. 4 is a cross-sectional view taken along the line IV—IV of FIG. 3.

Further, within the cylinder block 3, there is formed a bypass passage 50 for communicating the first suction chamber 24 and the suction passage 9 (see FIG. 4). The bypass passage 50 is in communication with the suction chamber 24 through a hole (not shown) formed in the side plate 2. Thus, the coolant is fed from the swash plate chamber 8 through the passage 26 to the suction chamber 24, further fed from the suction chamber 24 to the suction passage 9 through the hole of the side plate 2 and the bypass passage 50 and further returned back to the swash plate chamber 8 along a circulation flow path 51 as indicated by a one-dot and dash line in FIG. 1.

The operation of the thus constructed compressor will now be described.

When the above-described electromagnetic clutch is engaged to transmit the drive torque from the automotive engine, the shaft 12 begins to rotate within the cylinder block 3. The rotation of the shaft 12 is transmitted through the planar plate portion 20 of the shaft 12 and the slit 19 of the swash plate to the swash plate 18 to rotate the latter. Since the swash plate 18 is slanted relative to the shaft 12, the swash plate 18 is swung in accordance with the rotation, so that the piston 17 is reciprocated within the cylinder 7 in accordance with this swing motion.

In the case where the maximum discharge displacement is need to the compressor, the switching valve 40 is switched over so as to communicate the control chamber 41 with the second discharge chamber 33. Then, in FIG. 1, the pressure to be applied to the right side of the piston portion 47 of the spool 46 is higher than the pressure to be applied to the left side, so that the spool 46 is pressed leftwardly. At the same time, the central position of the swash plate 18 and the slider 42 are moved leftwardly, so that the left end of the slider 42 is brought into contact with the planar plate portion 20 of the shaft 12. This condition shown in FIG. 1. By the leftward movement of the swash plate 8, the projection portion of the swash plate having the pin 21 is moved leftwardly relative to the planar plate portion 20 of the shaft 12, so that the pin 21 is moved along the slant groove hole 22 of the planar plate portion 20 toward the left upward end to reach the position shown in FIG. 1. In accordance with the left upward movement of the pin 21, the swash plate 18 is rotated about the center of the spherical support portion 43 of the slider 42 to take a large slant angle.

Under the condition shown in FIG. 1, the piston 17 is reciprocated within the cylinder 7. The step for sucking the coolant into the front side working chamber 15 and the rear side working chamber 16 and the subsequent step for compressing the sucked coolant are alternatively performed. The coolant is introduced from the refrigerant cycle through the suction passage 9 and the swash plate chamber 8 to the suction chambers 24 and 32. The compressed coolant is discharged to the discharge chambers 25, 33. As described above, the swash plate 18 is moved in the axial direction of the shaft 12 so that the slant angle is changed largely and the central position is located substantially at the center in the longitudinal direction of the cylinder 7. Therefore, the piston 17 is reciprocated through a sufficient stroke, any decompression condition is not attained in the front and rear side working chambers 15 and 16, and the coolant compressed in the same manner is discharged from either of the working chambers. Accordingly, the flow of coolant is generated in either of the working chamber, the shaft sealing means 14 and the like are in contact with the flowing coolant, and the heat generated due to the friction with the shaft 12 is removed by the coolant. In this case, although some coolant flows through the bypass passage 50, it is unnecessary to demand a special cooling effect to the flow.

Also, in the case where the discharge displacement of the compressor must be kept at a minimum level, the change-over of the switching valve 40 causes the control chamber 41 to communicate with the second suction chamber 32. When, under this condition, the shaft 12 is rotated, and the swash plate 18 causes the piston 17 to move rightwardly in FIG. 1, as a result of the reactive force (leftward) applied to the piston 17, a force to decrease the inclination angle of the swash plate 18 is applied to the swash plate 18. Namely, the force to counterclockwisely rotate the swash plate 18 in FIG. 1 is applied to the swash plate 18 by the piston 17. The force to be applied to the swash plate 18 is limited by the fact that the pin 21 is slidingly engaged with the inclined groove hole 22 of the shaft, to form a component of force to press the central position of the swash plate 18 to the right in the axial direction of the shaft 12. This force component is transmitted to the spool 46 through the slider 42. As described above, since the pressure difference is not generated between both the sides of the piston portion 47 of the spool 465, the piston portion 47 is moved to the right extremity as shown in FIG. 2.

Thus, the inclination angle of the swash plate 18 is made small, and at the same time, the central position is moved toward the rear side working chamber 16. The to dead center position in the rear side working chamber is kept at substantially the same position as in the case of the above-described maximum displacement operation. In other words, it is possible to make small the inclination angle of the swash plate 18 without change the top dead center position of the piston 17 in the rear side working chamber 16. As a result, it is possible to keep the discharge displacement of the compressor at a minimum level without any dead volume in the rear side chamber 16.

On the hand, in the condition shown in FIG. 2, the top dead center of the piston 17 in the front side working chamber 15 is displaced toward the bottom dead center side (i.e., rightward in FIG. 2). This would lead to the decompression condition in which the suction and discharge of the coolant is not substantially performed by the front side working chamber 15. Therefore, the coolant within the first suction chamber 24 in the front housing 1 is not sucked into the front side working chamber 15 so that the coolant is not flowed through the suction chamber 24. When this condition remains intact, there is a fear that a sticking would be generated in the shaft sealing means 14 or the like. In the compressor according to this embodiment, the first suction chamber 24 is communicated with the suction passage 9 through the bypass passage 50, and the pressure in the suction passage 9 is lower than the pressure within the bypass passage 50 by the flow of the fluid sucked from the suction passage 9 through the swash plate chamber 8 into the suction chamber 32. Therefore, the flow of the coolant passing through the recirculation flow path 51 even under the decompression condition will be ensured. Accordingly, the coolant is always flowed from the swash plate chamber 8 into the first suction chamber 24 to cool the shaft sealing means 14 and the like mounted within the suction chamber 24. Therefore, there is no fear that the sticking would be generated in the shaft sealing means 14 and the like.

As described above, in accordance with this embodiment, even if the front side working chamber of the compressor would be under the decompression condition, the shaft sealing means is cooled by the coolant by the recirculation flow path including the bypass passage. Therefore, there is no fear that a sticking would be generated due to the friction between the shaft sealing means and the shaft. Thus, the durability of the compressor may be enhanced.

A variable displacement-type swash plate compressor for refrigeration cycle in accordance with other embodiments of the invention will now be described with reference to FIGS. 5 to 13. In the following description, the like components or members will be designated by the reference numerals as those used in the foregoing description, and hence, the detailed explanation thereof will be omitted but the parts different from those of the first embodiment will only be explained.

Figure 5:
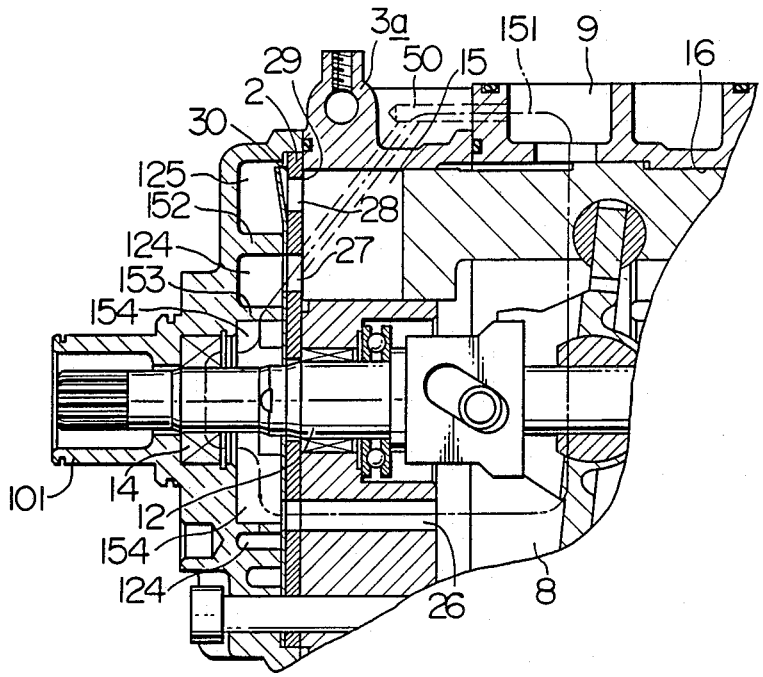
FIG. 5 is a cross-sectional view showing a primary part of a compressor in accordance with a second embodiment of the invention.
Figure 6:
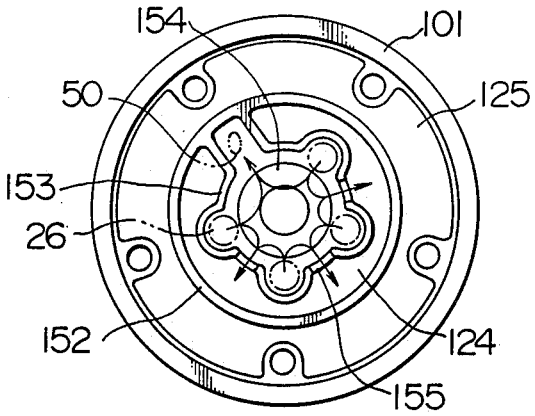
FIG. 6 is an end face view showing a front housing used in the compressor in accordance with the second embodiment.

FIG. 5 shows a primary part of the variable displacement swash-plate type compressor in accordance with the second embodiment of the invention. An annular rib 152 be shown in FIG. 6 is formed in a front housing 101 of the compressor. The rib 152 defines a first suction chamber 124 and a discharge chamber 125. Furthermore, inside of the rib 152, there is formed a second rib 153 coaxially therewith to partition the space within the rib 152. The inner space is used to form a shaft sealing chamber 154 which surrounds the shaft sealing means 14. The shaft sealing chamber 154 is in communication with the swash plate chamber 8 through holes formed in the side plate 2 and the first passages 26 formed in the front cylinder block *3a*.

On the other hand, an outer space of the second rib 153 forms a first suction chamber 124 which is in communication with a front side working chamber 15 through a suction hole 27 formed in the side plate 2. FIG. 6 shows only open ends on the side of the first passages 26. The suction ports or second passages 27 are formed to open to the outside of the second rib 153 in FIG. 6. Also, a first discharge chamber 125 is in communication with the front side working chamber 15 through discharge holes 28 formed in the side plate 2. Thus, the coolant is fed from the swash chamber 8 through the first passage to the shaft sealing means 14 disposed in the shaft sealing chamber 154. Thereafter, the coolant is fed to the suction path 9 through a bypass passage 50 and a hole formed in the side plate 2 and recirculated back to the swash plate chamber 8 to form a recirculation flow path 151.

The structure of the second embodiment may be the same as that of the first embodiment except for the parts described above.

In the maximum displacement operation, the compressed coolant is discharged from the front and rear side working chambers 15 and 16 substantially in the same manner. Therefore, in this case, the coolant that has flowed from the suction passage 9 into the swash late chamber 8 is allowed to flow to both right and left sides of the compressor through the first passages 26 in the front side and the like passages formed in the rear side. The coolant that has flowed on the side of the front housing 101 through the first passages 26 is first made to flow into the shaft sealing chamber 154 within the front housing 101. Subsequently the coolant flows into the suction chamber 124 side through the flow holes 155 (FIG. 6) formed in the second rib 153. The coolant that has been introduced into the suction chamber 124 within the front housing is intermittently sucked through the suction holes 27 and the discharge valves 30 into the discharge chamber 125. As a result, the shaft sealing means 14 is always cooled by the coolant that flows in contact with the shaft sealing means 14, so that the heat generated due to the friction between the shaft sealing means 14 and the shaft 12 is removed by the coolant. Thus, the shaft sealing means is cooled at 40° C. in the maximum displacement operation.

On the other hand, in the minimum displacement operation, in the same manner as in the first embodiment, the front side working chamber 15 is kept under the condition that almost no suction or discharge of the coolant is performed. According to the studies of the present inventors, it has been found that if the coolant does not flow through the compressor during the operation, the temperature of the shaft sealing means reaches 100° C. However, in the compressor according to the invention, the shaft sealing chamber 154 is communicated with the suction passage 9 through the bypass passage 50. Also, the pressure within the suction passage 9 is decreased at a level less than the pressure of the bypass passage 50 by the flow of the coolant sucked from the suction passage 9 to the swash plate chamber 8. Therefore, even in such a decompression condition, there is the flow of the coolant through the recirculation flow path 151. As a result, the coolant is always made to flow from the suction chamber 124 into the swash plate chamber 8, to thereby cool and lubricate the shaft sealing means 14 installed within the shaft sealing chamber 154. Therefore, there is no fear that the shaft sealing means 14 would be stuck. In this case, since the coolant is flowed from the first passages 26 through the shaft sealing means chamber 154 and the bypass passage 50 into the suction passage 9 owing to the venturi effect at the suction passage, the flow amount of that coolant itself is not so large. However, according to the studies of the present inventors, it has been found that the temperature of the shaft sealing means is cooled by 10° to 20° C. by the provision of the coolant recirculation.

In particular, in the compressor in accordance with the second embodiment, since the opening end of the bypass passage 50 is opened opposite the opening ends of the first passages 26 through the shaft sealing means 14, even if the amount of the recirculated coolant is small, it is possible to ensure the cooling effect for the shaft sealing means 14. In addition, since the volume of the interior of the shaft sealing means chamber 154 is selected to a small level by the second rib 153, the recirculated coolant flow may be further effectively utilized.

Figure 7:
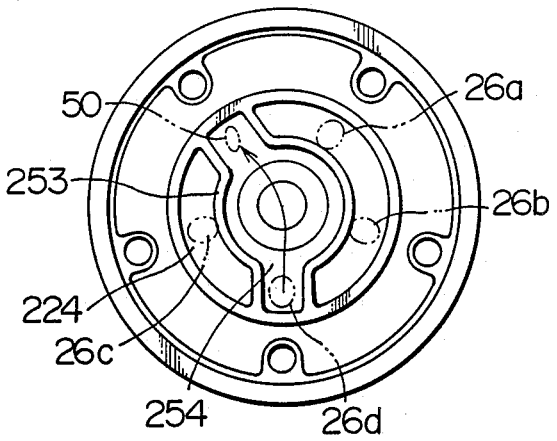
FIG. 7 is an end face view showing a front housing used in a modification of the second embodiment.

FIG. 7 shows a modification of the compressor in accordance with the second embodiment. In this example, in a second rib 253, there are no passage holes as in the second embodiment. Accordingly, in accordance with this modification, the shaft sealing means chamber 254 is interrupted from the first suction chamber 224. Then, one of plural first passages 26 is opened to the shaft sealing chamber 254. In other words, the other first passage 26 are opened directly to the suction chamber 224.

Therefore, according to the modification shown in FIG. 7, the coolant that has flowed from the suction chamber 224 into the front side working chamber is introduced through all the passages (*26a, 26b* and *26c* in FIG. 7) opened to the suction chamber 224. Oh the other hand, the coolant that is introduced into the shaft sealing means chamber 254 is fed from the passage *26d* in FIG. 7. In addition, the passage opened to the shaft sealing means chamber 254 is located diametrically opposite to the opening of the bypass passage 50. Therefore, according to the modification shown in FIG. 7, in addition to the effect of the decreased volume of the shaft sealing means chamber 254, it is possible to further ensure the cooling and lubrication of the shaft sealing means in a more preferable condition.

According to the second embodiment and the modification thereof, since the shaft sealing means chamber is provided independently of the suction chamber within the front housing, it is possible to introduce the fluid from the swash plate chamber through the first passage into the shaft sealing chamber, and subsequently to escape the fluid through the bypass passage to the suction passage. Therefore, in the compressor in this embodiment, the fluid that has recirculated from the swash plate chamber through the first passages and the bypass passage to the suction passage may be fed to the sealing means without fail, to thereby cool and lubricate the sealing means. Thus, the sticking of the shaft sealing means may be avoided and the sealing effect of the sealing means may be ensured.

Figure 8:
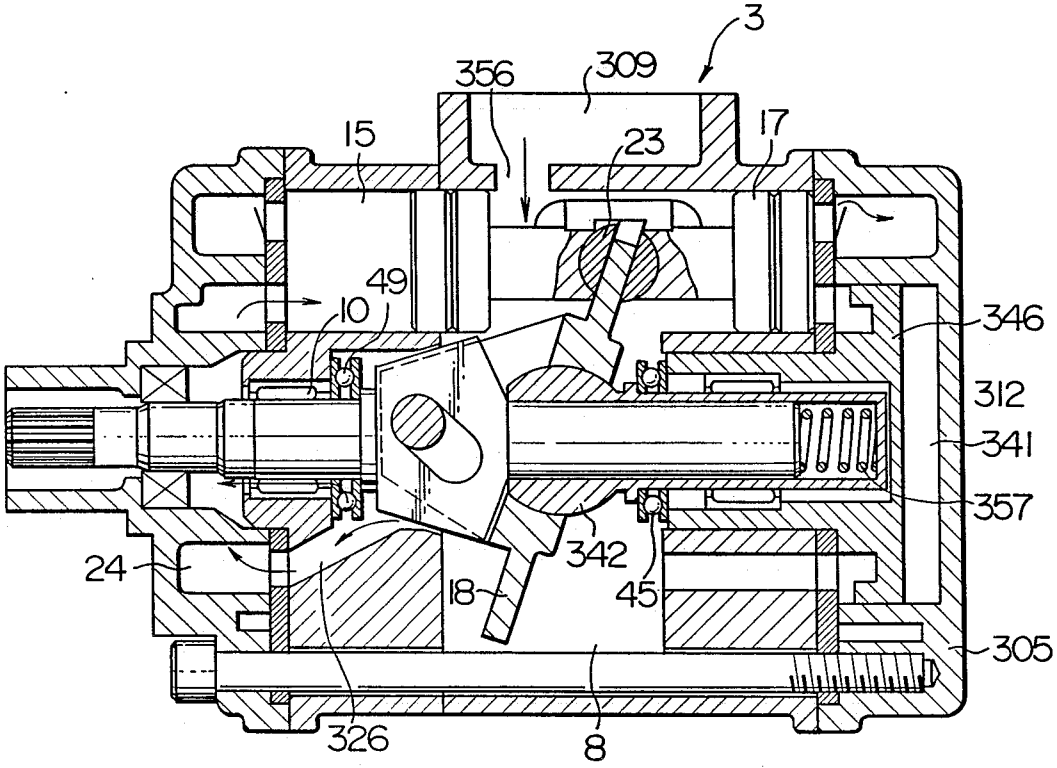
FIG. 8 is a cross-sectional view showing a compressor in a minimum displacement operation in accordance with a third embodiment of the invention.

FIG. 8 shows a variable displacement swash plate type compressor for refrigeration cycle in accordance with a third embodiment of the invention, which pertains to the lubrication and cooling of the front side thrust bearing. Since the location of the front side thrust bearing 49 is restricted due to the configuration of the shaft 312, the slider 342 or the like and the compressor is to be compact, it is difficult to expose the thrust bearing in the coolant. The thrust bearing is located in the deep position. Therefore, it is just expected that the thrust bearing would be lubricated only by the small flow amount of the coolant which passes through a gap between the first bearing means 10 and the shaft 312. This lubrication condition is quite undesirable. In addition, since the thrust bearing is exposed in a relatively severe or hard condition under the load condition, it is necessary to sufficiently lubricate the thrust bearing. In a compressor, since the sliding parts thereof are lubricated by the lubricant oil contained in the coolant, if the flow of the coolant to the front side working chamber 15 side is stopped, there is a fear that the sticking would be generated in the sliding parts.

In the compressor in accordance with the third embodiment in which a communication part 356 is provided in the upper portion of the cylinder block 3 to communicate the suction passage 309 and the swash plate chamber 8 with each other. The coolant that has been introduced through the communication port 356 from the side of the evaporator of the refrigeration cycle is fed into the swash plate chamber 8 within the cylinder block 3. As is apparent from FIG. 8, the communication port 356 is opened to the upper side of the slider 342, so that the coolant that has flowed through the communication port 356 is used to cool and lubricate the swash plate 18, shoes 23, slider 342 and the like. Also, the rear side thrust bearing 45 is arranged to be exposed directly to the swash plate chamber 8, so that the rear thrust bearing 45 may be cooled and lubricated by the coolant through the communication port 356. On the other hand, the thrust bearing 49 on the front side is restricted in location as described before, and it is therefore difficult to arrange it so as to be exposed directly in the swash plate camber 8.

Accordingly, in the compressor according to this embodiment, the first passages 326 for communicating the swash plate chamber 8 and the front side first suction chamber 24 with each other is slanted and opened at one end in the vicinity of the thrust bearing 49.

Also, the compressor according to the third embodiment is provided with a cylindrical suction chamber space within the rear housing 305. A spool 346 which serves as a piston is disposed in that annular space to form a control chamber 341. A discharge pressure is selectively introduced into the control chamber 341 by a control valve (not shown). A coil spring 357 is interposed between an end portion of the slider 342 on the side of the spool 346 and an end portion of the shaft 312, so that, when the pressure within the control chamber 341 is decreased, the slider 342 and the spool 346 are moved rightwardly (FIG. 8) to decrease the inclination of the swash plate 18.

In the large displacement operation of the compressor, the low temperature and low pressure coolant that has been introduced from the communication port 356 into the swash plate chamber 8 is in contact with the sliding parts relative to the shoes 23, 23, the slider 342, the thrust bearing 45 and the like. The contact of the coolant causes the sliding parts to be cooled and lubricated. Also, in the compressor according to the embodiment, since the first passages 326 are located in the vicinity of the thrust bearing 49, the coolant that flows from the swash plate chamber 8 through the first passages 326 to the first suction chamber 24 will also contact with the thrust bearing 49. Therefore, by the contact of the coolant therewith, the thrust bearing 49 may be cooled and lubricated without fail.

On the other hand, under the small displacement operation of the compressor which is required by the refrigeration cycle, the pressure within the control chamber 341 is reduced by the control valve (not shown). As a result, the differential pressure in the front and rear sides of the spool 346 becomes low, and the spool 346 is moved to the right (FIG. 8) by the reaction generated during the compression stroke of the piston 17. As a result, the compression or suction of the coolant is not attained in the front side working chamber 15. Therefore, there is no flow of coolant that passes from the swash plate chamber 8 to the first passages 326. Thus, the flow of coolant passes from the first passages 326 to the suction chamber 24 is also stopped. This means that the lubrication of the thrust bearing 49 by the coolant passing through the first passage is interrupted. However, since in such a small displacement operation, the thrust load applied to the thrust bearing 49 is decreased, a fear of the sticking or the like would be avoided.

Figure 9:
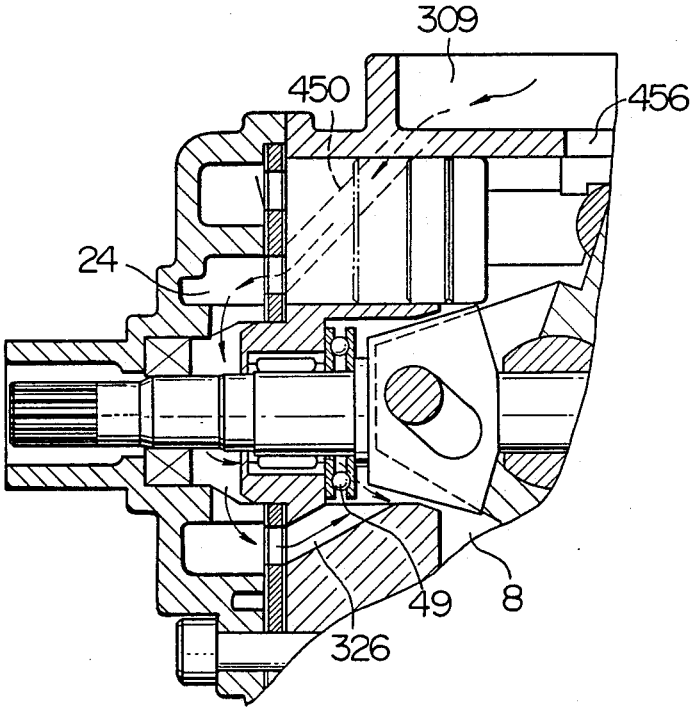
FIG. 9 is a cross-sectional view showing a primary part of a compressor in accordance with a fourth embodiment of the invention.

It is, however, possible to provide a bypass passage as in the first embodiment in order to flow the coolant on the side of the thrust bearing 49 without fail even in the small displacement operation. FIG. 9 shows a compressor according to a fourth embodiment provided with such a bypass passage.

The compressor according to the fourth embodiment is formed in the same manner as in the second and third embodiment except for the bypass passage 450, which is used to communicate the suction passage 309 and the first suction chamber 24 with each other to introduce the coolant directly into the suction chamber 24 while bypassing the communication portion 456 and the swash plate chamber 8. In this embodiment, the bypass passage 450 is opened to follow the flow of the coolant through the suction passage 309. Therefore, unlike the first embodiment, the coolant is introduced from the bypass passage 450 into the first suction chamber 24 and then fed through the first passages 326 into the swash plate chamber 8.

Therefore, if the bypass passage 450 is provided as described above, then the coolant will flow through the first passages 326 irrespective of the discharge displacement of the compressor. The open ends of the first passages 326 are located in the vicinity of the thrust bearing, whereby it is possible to cool and lubricate the thrust bearing 49 with the coolant flowing through the first passages 326.

As described above, in the third embodiment, since one end of the passage for communicating the swash plate into which the fluid is flowed and the suction chamber on the front side is opened in the vicinity of the thrust bearing on the front side, it is possible to ensure the cooling and lubrication for the thrust bearing with the flow of sucked coolant. As a result, it is possible to ensure the thrust force in the compressor. Furthermore, as in the four embodiment, by providing the bypass passage, it is possible to cool and lubricate the front side thrust bearing even during the minimum displacement operation.

Figure 10:
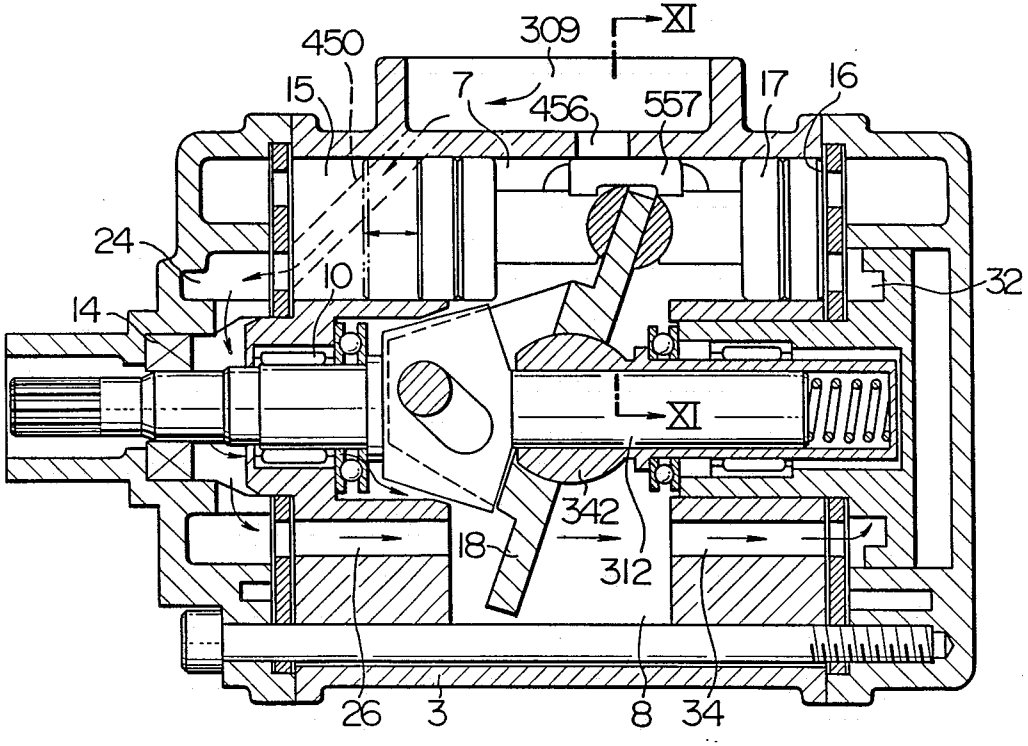
FIG. 10 is a cross-sectional view showing a compressor in accordance with a fifth embodiment of the invention.

A swash plate type compressor in accordance with a fifth embodiment as shown in FIG. 10 is constructed substantially in the same manner as the fourth embodiment except for the point that the first passages 26 on the front side within the cylinder block 3 is not opened close to the thrust bearing and a member 557 for opening/closing the communication port 456 is provided above the piston 17.

Figure 11:
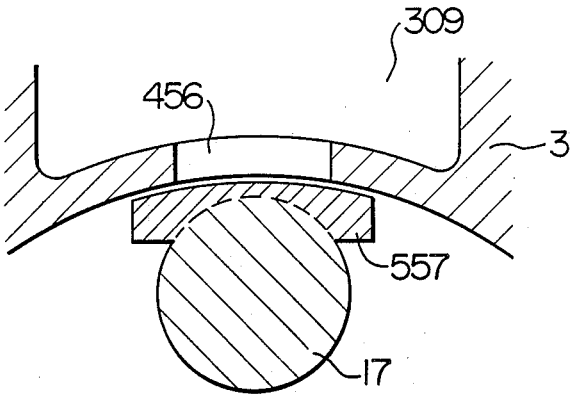
FIG. 11 is a cross-sectional view taken along the line XI—XI of FIG. 10.

As described above, the communication port 456 is opened to the upper portion of the cylinder block 3 and communicates with the uppermost cylinder 7. The opening/closing member 557 is formed on the piston 17 which reciprocates within the cylinder 7. As shown in FIG. 11, the opening/closing member 557 may directly confront with the communication port 456. Where the member 557 is in confront relation with the communication port 456, the communication port 456 is closed thereby. The opening and closing the communication port 456 by the member 557 is controlled in accordance with the reciprocation stroke and position of the piston 17.

Figure 12A:
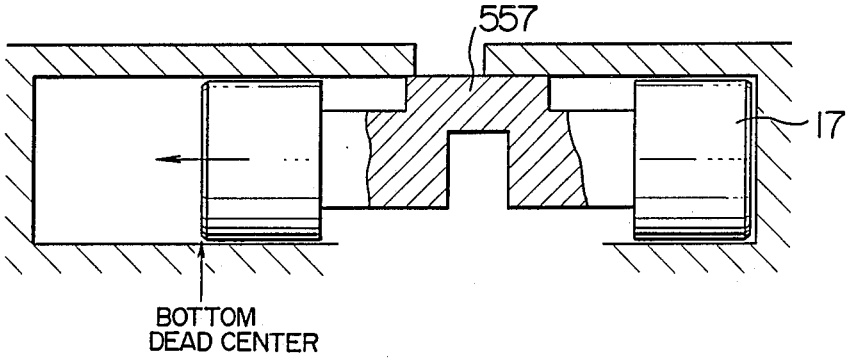
FIG. 12*a* to 12*c* are schematic views showing shift conditions of an opening/closing member and a piston in the compressor in accordance with the fifth embodiment.
Figure 12B:
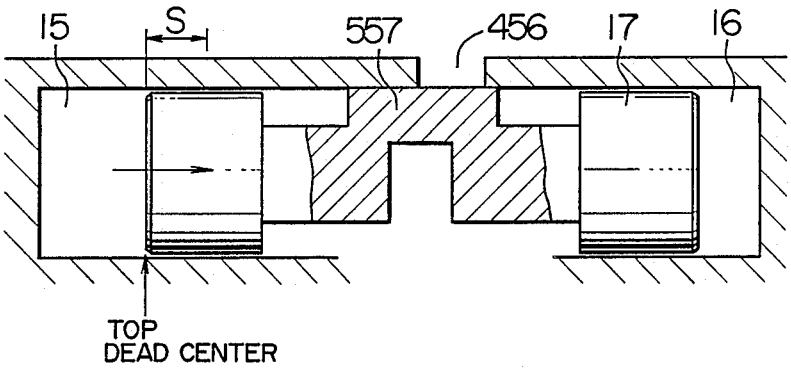

FIGS. 12*a* and 12*b* show a state where the piston 17 is positioned toward the rear side working chamber 176 and at the same time is reciprocated over a small stroke. Under this condition of the stroke S, the opening/closing member 557 always closes the communication port 456. Also, in the condition of FIGS. 12*a* and 12*b*, a dead space in the front side working chamber 15 is increased. This condition corresponds to the solid lines B through D shown in FIG. 15 as described before. Namely, the condition that the opening/closing member 557 close the communication port 456 corresponds to the condition that the pressure within the front side working chamber should not exceed the discharge pressure Pd.

Figure 12C:
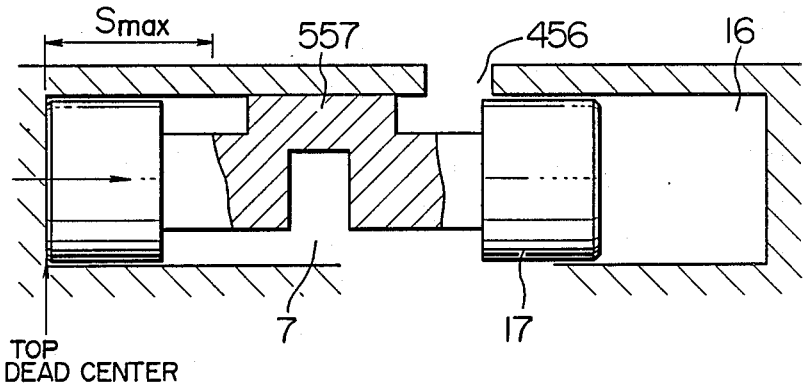

FIG. 12*c* shows a state where the piston 17 is reciprocated within a cylinder at a large stroke. Under this condition, when the piston 17 is shifted toward the front side working chamber 15, the opening/closing member 557 opens the communication port 456. Also, the condition shown in FIG. 12*c* corresponds to the operating condition shown from the solid lie A to the solid lien B in FIG. 15.

In the maximum displacement operation of this embodiment, as described above, the slider 342 is moved leftmost (in the figures), and the inclination of the swash plate 18 kept at a maximum level. Under this condition, the discharge displacement of the compressor is also at a maximum level, and a large amount of coolant is sucked from the evaporator side of the refrigeration cycle. In addition, under this condition, the opening/-closing member may open the communication port 456 as shown in FIG. 12*c*. As is apparent from FIG. 12*c*, if the piston 17 is advanced beyond a predetermined level toward the front working chamber, the opening/closing member 557 opens the communication port 456. Therefore, in such condition that a large amount of coolant be provided, the coolant is sucked through both the bypass passage 450 and the communication port 456 to avoid a loss of suction efficiency.

On the other hand, in the minimum displacement operation of the compressor, since the bypass passage 450 communicates the communication the suction passage 309 and the first suction chamber 24 with each other, even if the front side working chamber 15 does not work for the compression effect, the coolant is always fed into the first suction chamber 24. Then, the coolant that has been introduced into the suction chamber 24 is subsequently sucked into the second suction chamber 32 through the first passages 26, the swash plate chamber 8 and the passage 34. In other words, in the compressor according to this embodiment, by the sucked compressed fluid compression effect concomitant with the operation of the rear side working chamber 16, the fluid is also fed to the first suction chamber 24 side. The coolant to be sucked into the first suction chamber 24 is used to cool and lubricate the first bearing means 10 and also to lubricate the seal portion of the shaft sealing means 14. Therefore, even if the discharge displacement is at the minimum level, the shaft 312 may be rotated in a desired condition and the sale around the shaft 312 may be ensured.

However, under such a condition, if the communication port 456 is largely opened, then the coolant within the suction passage 309 is sucked mainly from the communication port 456 to the swash plate chamber 8, and would be introduced into the rear side suction chamber 32. In this case, if a large amount of coolant is sucked from the side of the communication port 456, then the flow rate of coolant sucked into the bypass passage 450 is decreased. This would leads to an insufficient sliding of the shaft sealing means 14, the bearing 10 and the like.

Therefore, in the compressor according to this embodiment, in such a compressor according to this embodiment, in such a condition, the communication port 456 is closed by the opening/closing member 557.

Namely, in the minimum operation condition, the slider 342 is moved in the right direction (in FIG. 10), and the reciprocation range of the piston 17 is shifted toward the rear side working chamber 16 according to the movement of the slider 342. FIGS. 12*a* and 12*b* shows the top and bottom dead center positions of the piston 17 kept under this condition. Under such a condition that the piston 17 is shifted toward the rear side working chamber 16, the opening/closing member 557 closes the communication port 456 over the entire region from the top dead center position to the bottom dead center position.

In the compressor according to this embodiment, in the small displacement condition of the compressor in which the sucked coolant amount is reduced, it is possible to completely close the communication port 456, as a result of which it is possible to ensure the coolant flow toward the bypass passage 450.

Incidentally, under this condition, the coolant which is sucked into the rear side suction chamber 342 is fed from the suction passage 309, trough the bypass passage 450, the first suction chamber 24, the first passages 26, the swash plate chamber 8 and the passage 34. Thus, the suction passage thereof is long. However, under such a condition, since the compressor as a whole needs a small amount of displacement, even if the coolant has passed through such a long suction passage, there is almost no disadvantage due to the resistance of the suction reduction caused by the long suction passage.

Although, in the foregoing embodiment, the opening/closing member 557 formed in the piston 17 completely closes the communication port 456 during the small displacement operation, it is not always necessary to completely close the communication port 456 with the opening/closing member 557. Namely, it is sufficient that the opening/closing member 557 may ensure the flow of coolant toward the bypass passage 450, and may apply a resistance to the communication port 456 above a predetermined level.

Also, in the foregoing embodiment, the opening/closing member is formed integrally with the piston 178, a discrete opening and closing member 557 may be mounted on the piston 17.

Furthermore, it is possible to provide the opening/closing member 557 separately from the piston 17 to open and close the communication port 456 at a different position from that of the piston 17.

Figure 13:
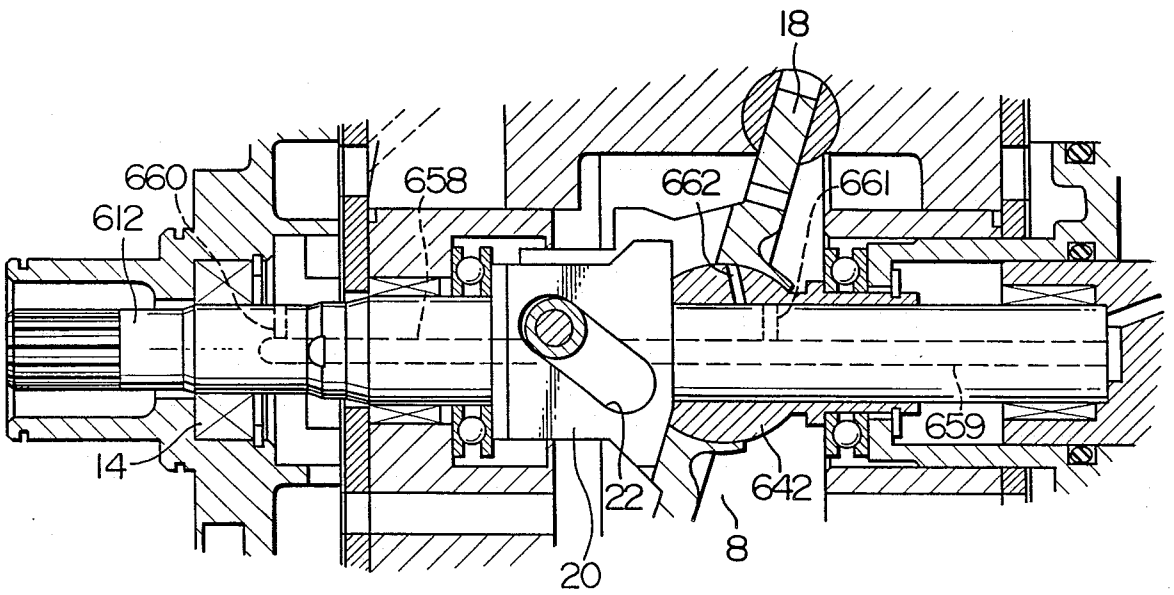
FIG. 13 is a cross-sectional view showing a modification of the first embodiment.

A modification of the first embodiment will now be described with reference to FIG. 13. In this modification, in this embodiment, in the central portion of a shaft 612, there are formed front and rear oil feed passages 658 and 659 which extend along the axis of the shaft, respectively. The oil feed passages 658 and 659 are opened at first ends to the inclination groove hole 22 of the planar plate portion 20. Radially extending oil feed holes 660 and 661 are formed in the shaft 612. First ends of the oil feed holes 660 and 661 are opened to the oil feed passages 658 and 659, and the other, second ends thereof are opened to the outer surface of the shaft 612. The oil feed holes 660 and 661 are opened to parts which should be lubricated within the compressor. In accordance with this modification, the oil feed hole 660 is formed in the vicinity of the shaft sealing means 14 and the oil feed hole 661 is formed in the slider 642.

Moreover, an oil feed hole 662 is radially formed in the spherical support portion of the slider 642 so that the lubricant fed from the oil feed hole 661 may reach the outer surface of the spherical support portion due to the centrifugal force.

In the operation of this compressor, the coolant that has been introduced into the swash plate chamber 8 is brought into contact with the planar plate portion 20 of the shaft 612 and the central portion of the swash plate 18. Also in this example, the lubricant is contained in the coolant as usual in the compressor used in an air-conditioning means, the lubricant lubricates the respective parts. In particular, since the volume of the swash plate chamber 8 of the compressor is abruptly increased in comparison with other components such as coolant pipings, the lubricant is likely to be separated from the coolant. Therefore, the lubricant oil is separated from the coolant in contact with the planar plate portion 20 to dew on these members.

The lubricant that has dewed on the planar plate portion 20 is introduced into the inclination groove hole 22 having a large opening area. The lubricant oil that has been introduced there will enter into the oil feed passages 658 and 659 to flow in the axial direction. When the oil reaches the oil feed holes 660 and 661, it flows to jump radially outwardly due to the centrifugal force. The lubricant oil thus fed into the inclination groove hole 22 will flow through the oil feed passages 658 and 659 to the lubrication needed parts of the compressor.

According to this modification, since the oil feed hole 660 is opened close to the shaft sealing means 14, unit is possible to smoothly cool and lubricate the seal surface of the shaft sealing means. Also, since the oil feed hole 661 is opened to the inner surface of the slider 642, the slider 642 may be smoothly slid along the outer surface of the shaft 612, and the lubrication of the spherical support portion of the slider and the swash plate 18 may be smoothly performed by the lubricant oil fed through the oil feed hole 662 of the slider 642. Therefore, it is possible to smoothly perform the lubrication of the compressor parts from the small displacement operation to the large displacement operation of the compressor.

In the foregoing embodiment, although the oil feed passages 658 and 659 are formed in both the front and rear side of the shaft, it is possible to form the oil feed passage only in the rear side. Also, the oil feed holes 660 and 661 are not restricted to the positions shown, but it is possible to form the oil feed holes so as to open toward the parts to be supplied with oil in the compressor. In the forgoing example, although the oil feed hole 662 is provided also in the slider 642, the oil feed hole 662 may be dispensed with as desired. Furthermore, it is sufficient that the oil feed holes 660 and 661 are formed from the oil feed passages 658 and 659 to the outer surface of the shaft. Therefore, it is not always necessary to intersect the oil feed holes 660 and 661 relative to the oil feed passages 658 and 659 at a right angle.

According to this example, the lubricant flowing through the oil feed passage is fed from the oil feed hole to the outer surface of the shaft. As a result, even if any special oil supplying means such as oil pump or the like is not provided, it is possible to perform the supply of lubricant oil by the centrifugal force concomitant with the rotation of the shaft. This example has been explained as a modification of the first embodiment, but it is apparent that such a modification may be applied to the other embodiments.

Although the foregoing description has been concerned with the specific embodiments and modifications, it will readily be understood that the invention may be modified by those skilled in the art within the scope of the appended claims.

What is claimed is:

1. A variable displacement swash plate type compressor comprising:

a cylinder block for defining therein cylinders and a swash plate chamber provided with a suction passage for introducing fluid into said swash plate chamber;

a front housing and a rear housing for covering both ends of said cylinder block;

shaft sealing means disposed in said front housing;

a shaft rotatably supported in said cylinder block and extending outside through said shaft sealing means;

a swash plate disposed within said swash plate chamber and mounted on said shaft for rotation with said shaft;

pistons reciprocatable within said cylinders while being subjected to swing motion of said swash plate, and defining front side working chambers and rear side working chambers in cooperation with inner surfaces of said cylinders;

a slider for supporting a center of rotation of said swash plate so that said swash plate is rotatable about an axis of said shaft and is movable in the axial direction of said shaft;

a spool for shifting said slider in the axial direction of said shaft to shift the center of rotation of said swash plate in the axial direction of said shaft, while keeping a top dead center position of each piston substantially unchanged within said rear side working chamber, thereby changing strokes of said pistons, said top dead center position of said pistons within said rear working chambers is kept substantially unchanged even if said slider is shifted in the axial direction of said shaft by said spool;

a suction chamber formed within said front housing for receiving said shaft sealing means and communicating with said swash late chamber through a first passage and with said front side working chambers through suction valves; and a bypass passage for communicating said suction chamber and said suction passage.

2. A variable displacement swash plate type compressor comprising:

a shaft;

a cylinder housing for defining a swash plate chamber and a plurality of cylinder bores each of which extends around said shaft in parallel thereto;

a swash plate provided in said swash plate chamber, mounted on said shaft for rotation therewith, and inclined relative to said shaft;

pistons slidably inserted into said cylinder bores, respectively, for defining pairs of working chambers in cooperation with said cylinder bores at both ends of said pistons, each of said pistons being connected to said swash plate and being reciprocated in accordance with a swing motion concomitant with rotation of said swash plate for sucking fluid to said pairs of working chambers, compressing the fluid in said working chambers and discharging the fluid from said working chambers;

support means for supporting said swash plate so as to be swingable relative to said shaft and to be movable in an axial direction of said shaft, thereby selectively varying inclination of said shaft and shifting a center of rotation of said swash plate along said shaft;

suction chambers respectively arranged adjacent to said pairs of working chambers;

suction passage means for supplying the fluid through said swash plate chamber to said suction chambers; and a bypass passage bypassing said swash plate chamber for communicating said suction passage means and the suction chamber located on a first side of said shaft;

whereby, when the inclination of said swash plate is decreased and the center of rotation of said swash plate is shifted so that substantially no suction, compression and discharge of the fluid is completed in the working chambers located on said first side of said shaft to decrease displacement of the compressor, the fluid is recirculated through said bypass passage into said suction chamber located on said first side responsively to a flow of the fluid into said working chambers on a second side of said shaft, thereby lubricating and cooling sliding parts relative to said shaft, disposed in contact with said suction chamber located on said first side.

3. The compressor according to claim 2, wherein said suction passage means is in communication with said swash plate chamber so that the flow of fluid is directed to said swash plate and said support means.

4. The compressor according to claim 2, further comprising a thrust bearing mounted adjacent to said suction chamber on said first side, a mounting portion for said thrust bearing being in communication with said swash plate chamber, and a first passage for communicating a vicinity of said thrust bearing mounting portion and said suction chamber on said first side with each other.

5. The compressor according to claim 2, wherein said bypass passage is opened at one end thereof to said suction passage means substantially in confronting relation with a flow of the fluid passing through said suction passage means, so that the fluid is introduced from said bypass passage through said suction chamber on said first side to said swash plate chamber.

6. The compressor according to claim 2, further comprising an oil feed passage which is communicated at one end thereof with an opening formed in a part of said shaft near to said support means and is opened at another end thereof to at least one of sliding parts on said shaft.

7. The compressor according to claim 2, wherein said bypass passage is opened at one end thereof to said suction passage means at a substantially right angle relative to a flow of the fluid passing through said suction passage means, so that the fluid is sucked by the flow in said suction passage means to pass from said swash plate chamber through suction chamber on said first side and said bypass passage.

8. The compressor according to claim 7, wherein the recirculated fluid lubricates and cools a shaft sealing device disposed in said suction chamber on said first side.

9. The compressor according to claim 2, further comprising a chamber for receiving a shaft sealing device formed between said bypass passage and the suction chamber on said first side, so that the recirculated fluid lubricates and cools said shaft sealing device disposed within said shaft sealing means chamber.

10. The compressor according to claim 9, wherein said shaft sealing device chamber is formed within said suction chamber on said first side, and another end of said bypass passage is opened to said shaft sealing device chamber, and said shaft sealing device chamber is communicated with said first side suction chamber arranged on an opposite side to the open end of said bypass passage with said shaft sealing device disposed therebetween.

11. The compressor according to claim 2, further comprising means for opening and closing communication between said suction passage means and said swash plate chamber.

12. The compressor according to claim 11, wherein said opening and closing means communicates said suction passage means and said swash plate chamber in response to the inclination of said swash plate.

13. The compressor according to claim 11, wherein said opening and closing means communicates said suction passage means and said swash plate chamber with each other when the inclination angle of said swash plate exceeds a predetermined level so that said pistons are reciprocated above a predetermined stroke, whereas said opening and closing means interrupts communication between said suction passage means and said swash plate chamber when the inclination angle of said swash plate is less than the predetermined level so that said pistons are reciprocated below the predetermined stroke.

14. The compressor according to claim 13, wherein said opening and closing means is provided on one of said pistons.

* * * * *

UNITED STATES PATENT AND TRADEMARK OFFICE

CERTIFICATE OF CORRECTION

PATENT NO. : 4,963,074

DATED : October 16, 1990

INVENTOR(S) : SANUKI, et al.

It is certified that error appears in the above-identified patent and that said Letters Patent is hereby corrected as shown below:

On the Title Page:

[22] Filed: Jan. 4, 1989

Signed and Sealed this

Twenty-second Day of September, 1992

*Attest:*

DOUGLAS B. COMER

*Attesting Officer*

*Acting Commissioner of Patents and Trademarks*